United States Patent [19]

Anderson

[11] 4,307,524

[45] Dec. 29, 1981

[54] ICE REMOVING ATTACHMENT FOR A VEHICLE

[75] Inventor: Leonard E. Anderson, Roland, Iowa

[73] Assignee: Leaf Enterprises, Inc., Roland, Iowa

[21] Appl. No.: 156,178

[22] Filed: Jun. 3, 1980

[51] Int. Cl.[3] ..... E01H 5/00

[52] U.S. Cl. ..... 37/43 R; 172/784

[58] Field of Search ..... 37/10, 41 R, 43 R, 43 D, 37/43 E, 116.3, 117.5; 172/784, 785, 787, 145, 146, 149, 152, 153, 168, 175, 200; 404/90

[56] References Cited

U.S. PATENT DOCUMENTS

| | | | |
|---|---|---|---|
| 2,376,250 | 5/1945 | Holmes et al. | 37/43 D |
| 2,455,147 | 11/1948 | Traver | 172/146 X |
| 3,693,722 | 9/1972 | Brown | 172/785 X |
| 3,721,077 | 3/1973 | Van der Lely | 37/43 R |
| 4,056,328 | 11/1977 | Maxey | 37/10 X |
| 4,163,329 | 8/1979 | Neff | 172/149 X |

*Primary Examiner*—E. H. Eickholt

*Attorney, Agent, or Firm*—Zarley, McKee, Thomte, Voorhees & Sease

[57] ABSTRACT

An ice removing attachment for a vehicle includes an ice cutting roller rotatably supported transversely of a vehicle and including a plurality of spaced apart cutting discs having a plurality of circumferentially staggered cutting blades extended transversely between adjacent discs. Forward and rearward scraper blades are supported rearwardly of the roller for scraping away ice cut by the roller. The forward scraper blade has a plurality of teeth along the lower edge thereof defining open spaces between them. The rearward scraper blade has a lower scraper edge which is continuous along at least those transverse positions which follow in the path of the open spaces in the forward scraper blade. The roller and blades may be supported at the front of or beneath the vehicle or both. Roller portions at the front of the vehicle may be made steerable and, in certain embodiments, a toggle mechanism may be provided for rigidifying the vehicle suspension when the ice removing attachment is in operation.

16 Claims, 6 Drawing Figures

ICE REMOVING ATTACHMENT FOR A VEHICLE

BACKGROUND OF THE INVENTION

The present invention relates generally to apparatus for cutting and removing ice from a surface and more particularly to an ice removing attachment for a vehicle.

In spite of the heavy and quite sophisticated equipment presently employed by municipalities and counties for the removal of snow from public roads and highways, any ice buildup below the snow cover on such streets and highways is very difficult to remove. Such ice buildup can cause significant wear and damage to the blades of conventional snowplows and of course, creates a dangerous traffic hazard to unsuspecting drivers. Accordingly, there is a need for an apparatus for quickly and easily removing ice from road surfaces and the like.

Accordingly, a primary object of the invention is to provide an improved ice removing attachment for a vehicle.

Another object is to provide an ice removing attachment which effectively cuts the ice into sections and scrapes the cut sections from the underlying road surface or the like.

Another object is to provide an ice removing attachment including an ice cutting roller which makes a plurality of continuous parallel cuts with a plurality of transverse segmented cuts between them.

Another object is to provide an ice removing apparatus which includes a pair of scraper blades in combination with an ice cutting roller which coact to scrape the ice along the entire transverse extent of the cutter roller.

Another object is to provide an ice removing attachment wherein the cutter roller and scraper blades are independently vertically adjustable.

Another object is to provide an ice removing attachment for a vehicle including means for rigidifying the vehicle suspension when the ice removing apparatus is in operation.

Finally, an object of the invention is to provide an ice removing apparatus which is simple and rugged in construction and durable and efficient in operation.

SUMMARY OF THE INVENTION

The ice removing attachment of the present invention can be secured onto a heavy vehicle such as a dump truck or the like to remove ice from any surface traversed by the truck. The cutting roller of the invention slices the ice with continuous parallel cuts and segments the slices by staggered transverse cuts spaced therealong. The segmented sliced portions of the ice are then scraped from the road surface by a combination of scraper blades which follow each roller cutter to assure that the road surface is scraped along the entire transverse extent of the cutter roller which precedes the scraper blades. Cutter rollers on the front of the truck may be made steerable and are preferably vertically adjusably supported independently of the coacting scraper blades. A toggle mechanism may be provided for rigidifying the vehicle suspension when the ice removing attachment is in operation.

DESCRIPTION OF THE PREFERRED EMBODIMENT

Figure 1:
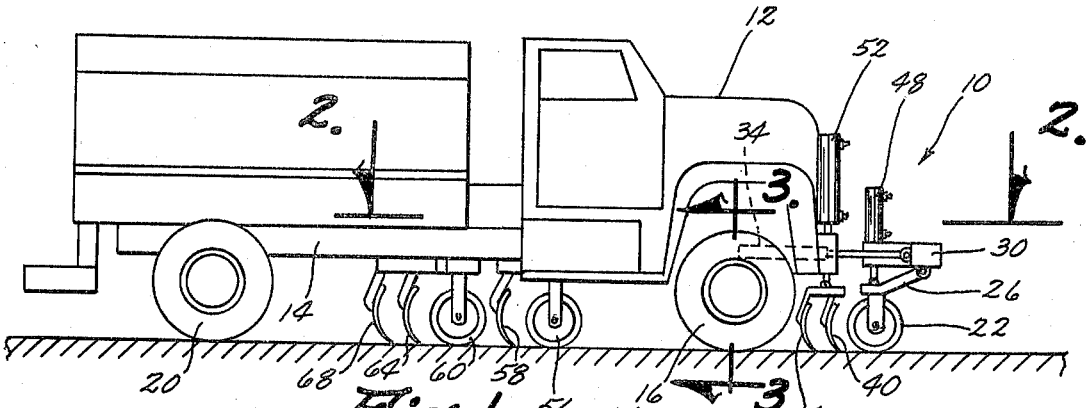
FIG. 1 is a side elevation view of a vehicle equipped with the ice removing attachment of the invention.

The ice removing attachment 10 of the present invention is shown in FIG. 1 in assembly relation with a dump truck vehicle 12. The vehicle 12 includes a frame 14, front wheels 16 which are steerable by linkage 18, and rear wheels 20.

Ice removing attachment 10 includes a pair of first and second cutting rollers 22 and 24 which are supported adjacent the forward end of vehicle 12 and forwardly of front wheels 16 in transversely spaced apart relation. The first and second cutting rollers 22 and 24 are each rotatably supported for rolling movement on the road surface in front of the vehicle by respective support frames 26 and 28 which in turn are secured to opposite end portions of a front tool bar 30 which is extended transversely across the forward end of the vehicle and mounted for pivotal movement about a generally vertical axis 32. Pivotal movement of tool bar 30 is controlled by a pair of elongated hydraulic cylinder units 34 and 36 which are connected at one end to the vehicle chassis 38 and at the opposite end to the tool bar 30.

Immediately rearwardly of first roller 22 there is mounted a pair of first scraper blades including a first forward blade 40 and a first rearward blade 42. A corresponding pair of second forward and rearward blades 44 and 46 are supported immediately rearwardly of the second cutting roller 24. It is seen that the first scraper blades 40 and 42 are transversely coextensive with first cutting roller 22 and the same is also true for the second scraper blades 44 and 46 relative to second cutting roller 24. The first and second rollers 22 and 24 and their corresponding sets of blades are positioned in front of the vehicle front wheels 16 so as to cut the ice on the road surface traversed by the front wheels.

Whereas the first and second cutting rollers 22 and 24 are closely associated with their respective pairs of first and second scraper blades, the blades are supported on the vehicle independently of the cutting rollers. For example, in FIGS. 1 and 2, it is seen that the first and second cutting rollers 22 and 24 are vertically adjustably positioned on the tool bar 30 by first and second hydraulic cylinder units 48 and 50. The first scraper blades 40 and 42, on the other hand, are vertically adjustably controlled by a third hydraulic cylinder unit 52 and the second scraper blades 44 and 46 are vertically adjustably controlled by a fourth hydraulic cylinder unit 54. The specific manner of connection of the scraper blades and/or hydraulic cylinder units to the vehicle frame or chassis is not critical to the present invention as many types of tool attachment structures are well known in the art.

Figure 2:
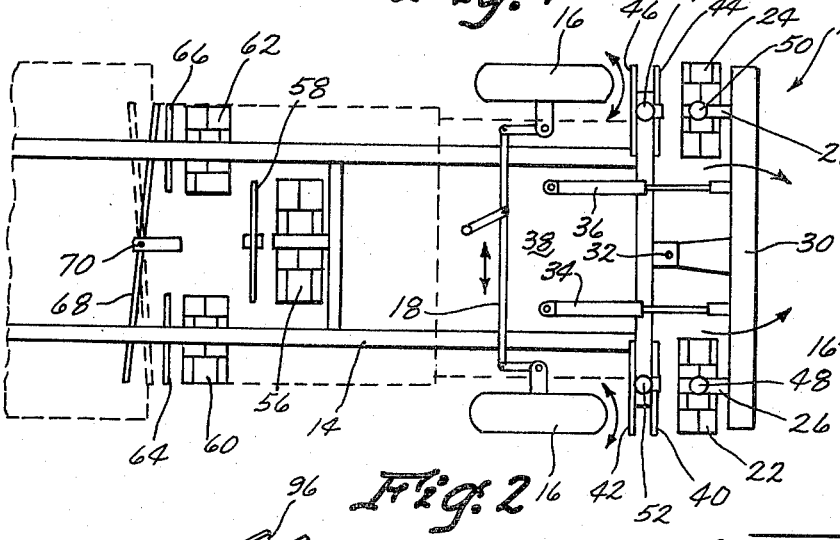
FIG. 2 is a top, partially sectional view taken along line 2—2 in FIG. 1.

A third ice cutting roller 56 is rotatably supported beneath the vehicle 12 rearwardly of front wheels 16 at a position generally transversely centered relative to the vehicle frame 14. A third scraper blade 58 which is approximately coextensive with the third roller 56, is supported in closely spaced trailing relation to the roller 56 as shown in FIGS. 1 and 2. Rearwardly of third blade 58, fourth and fifth ice cutting rollers 60 and 62 are rotatably supported in transversely spaced apart relation. The fourth and fifth rollers 60 and 62 are preferably positioned to at least slightly overlap the paths traversed by the first, second and third rollers 22, 24 and 56. Fourth and fifth scraper blades 64 and 66 are supported on the vehicle frame 14 in closely spaced trailing relation behind the fourth and fifth cutting rollers 60 and 62 respectively. Finally, rearwardly of the fourth and fifth scraper blades 64 and 66, an elongated sixth scraper blade 68 is supported for pivotal movement about a substantially upright axis indicated at 70. The sixth scraper blade 68 is preferably coextensive in length with the path traversed by the third, fourth and fifth blades 58, 64 and 66.

Figure 3:
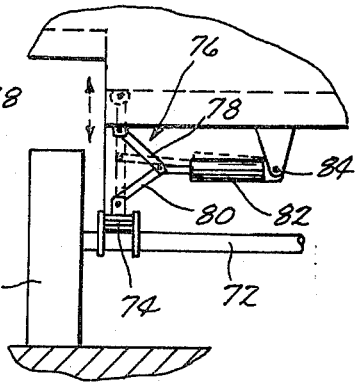
FIG. 3 is a partially sectional front view of the suspension stiffening toggle mechanism of the invention.

To facilitate the cutting action of the various ice cutting rollers, it is desirable to eliminate the action of the vehicle springs so that the vehicle weight may be applied directly to the cutting rollers and wheel axles. Referring to FIG. 3, it is seen that the vehicle front wheels 16 are rotatably mounted on an axle 72 which is connected by leaf springs 74 to the underside of the vehicle frame 14. To incapacitate the springs 74 during operation of the ice removing attachment 10, a toggle mechanism 76 is provided including a pair of toggle arms 78 and 80 having their common ends pivotally connected to one end of a hydraulic cylinder unit 82 anchored at the opposite end as at 84. Accordingly, upon extension of hydraulic cylinder unit 84, the vehicle chassis is raised to the dotted line position shown therefor in FIG. 3 with the toggle mechanism forming a rigid link between the chassis and axle 72. On the other hand, when hydraulic cylinder unit is relaxed and permitted to retract, the vehicle chassis 38 is lowered to the solid line position therefor in FIG. 3 wherein it is supported in the usual manner by leaf springs 74.

Figure 4:
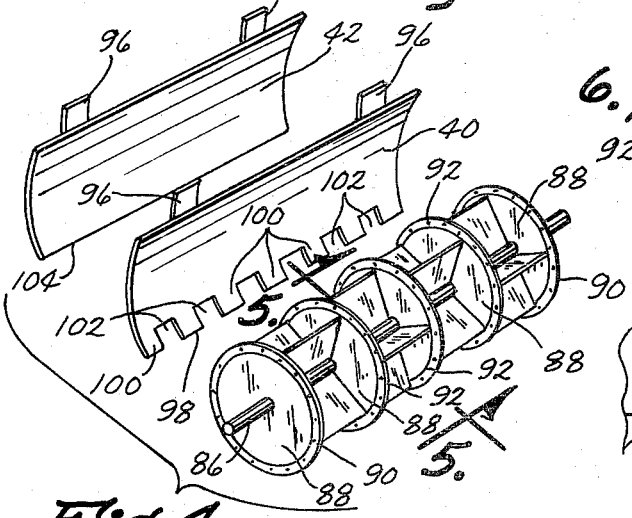
FIG. 4 is an enlarged perspective view of the cutter roller and scraper blades of the invention.
Figure 5:
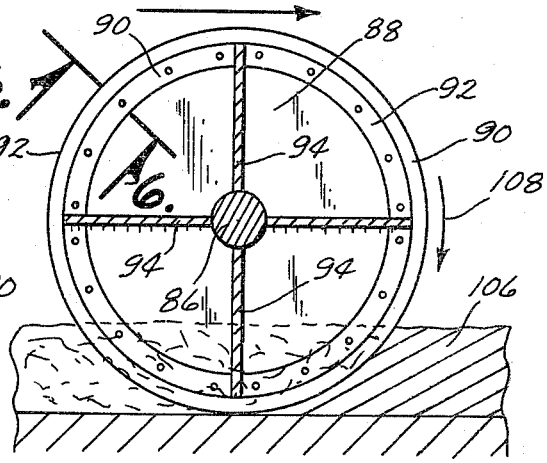
FIG. 5 is a further enlarged partially sectional detail view of the cutter roller as seen on line 5—5 of FIG. 4.
Figure 6:
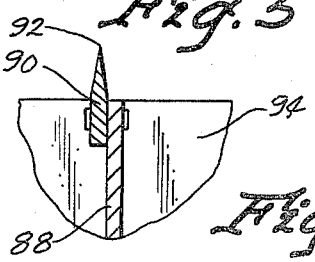
FIG. 6 is a further enlarged detail sectional view of a cutting disc as seen on line 6—6 in FIG. 5.

Referring to FIG. 4, the construction of the first cutting roller 22 and first scraper blades 40 and 42 shall now be described in greater detail. First cutting roller 22 includes a central axial shaft 86 having a plurality of circular discs 88 secured thereon at transversely spaced apart positions. Adjacent discs 88 are interconnected by a plurality of generally radially directed cutting blades extended transversely between them. In FIGS. 5 and 6, it is seen that each disc 88 has secured along its outer periphery a plurality of arcuate replaceable cutting segments 90 which cumulatively define an external peripheral cutting edge 92 adapted for cutting a continuous longitudinal cut in the ice surface traversed by the vehicle 12.

In the preferred embodiment, four transverse cutting blades 94 are disposed between each adjacent pair of discs 88, said cutting blades 94 being spaced apart at 90° angles to one another. Likewise, the cutting blades between each pair of discs 88 are offset approximately 45° relative to the cutting blades 94 between each adjacent pair of discs 88 for a purpose described below in connection with the cutting action of said rollers.

The first forward scraper blade 40 is shown in FIG. 4 as a somewhat arcuate upright and transversely extended blade member mounted on a pair of spaced apart leg members 96. The forward scraper blade 40 has a lower edge 98 which defines a plurality of scraper teeth 100 and open spaces 102 between them.

The first rearward scraper blade 42 is similar in construction to the first forward scraper blade 40 except that the rearward blade 42 has a lower scraper edge 104 which is continuous along at least those transverse positions which follow in the path of the open spaces 102 in the forward scraper blade 40. In the preferred embodiment, the lower scraper edge of the rearward scraper blade is continuous along the length of the rearward scraper blade.

Operation of the ice removing attachment 10 of the present invention is initiated by vertically extending the toggle mechanisms 76 of vehicles so equipped and then vertically adjusting the cutting rollers and associated scraper blades to positions in engagement with the road surface from which ice is to be removed. The vehicle 12 is then advanced forwardly causing the roller discs 88 and cutting blades 94 to cut into the ice 106 as shown in FIG. 5 thereby rotating the rollers in the direction of arrow 108. As the truck advances forwardly, the external peripheral cutting edges 92 of the various discs of each roller cut continuous parallel cuts in the ice on the surface traversed by the vehicle and the transverse cutting blades 94 cut a plurality of segmented cuts between the parallel cuts made by the discs. Because the cutting blades 94 between a given pair of discs 88 are circumferentially offset relative to the cutting blades between an adjacent pair of discs 88, the segmented cuts formed by the blades 94 between a given pair of discs are staggered relative to the cuts made by the cutting blades 94 between adjacent pairs of discs. The first forward blade 40 follows the first cutting roller 22 and the scraper teeth 100 thereof help to scrape and lift the cut ice from the road surface. Any portions of the cut ice which are missed by the forward blade due to the open spaces 102 between the scraper teeth are removed by the rearward blade 42.

Whereas the action of the cutting roller has been described in connection with the first cutting roller 22, it is understood that the second, third, fourth and fifth cutting rollers operate in a similar manner. Likewise, whereas the scraper teeth 100 are shown only on the first forward blade 40, it is understood that similar scraper teeth are provided on second forward blade 44 as well as the third, fourth and fifth scraper blades 58, 64 and 66. The second rearward blade 46 and sixth scraper blade 68 are preferably smooth edged or otherwise constructed similar to the first rearward blade 42.

To prevent binding of the first and second cutting rollers 22 and 24 during steering movements of the vehicle 12, the hydraulic cylinder units 34 and 36 may be coordinated with the steering linkage 18 to provide for steering movements of the tool bar 30 and first and second cutting rollers 22 and 24 therewith in unison with the vehicle front wheels 16. Accordingly, the vehicle 12 is not confined to linear movement during its ice removal operation.

Thus there has been shown and described an ice removing attachment which accomplishes at least all of the stated objects.

I claim:

1. An ice removing attachment for a vehicle comprising, an ice cutting roller, means for rotatably supporting said roller transversely of a vehicle, said roller including a plurality of spaced apart cutting discs having external peripheral cutting edges for cutting continuous parallel cuts in an ice surface, and a plurality of generally radially directed cutting blades extended transversely between each adjacent pair of discs for cutting transverse segmented cuts between said parallel cuts, forward and rearward scraper blades, means for supporting said forward and rearward scraper blades on a vehicle rearwardly of said roller for scraping away ice cut by said roller, said forward scraper blade including a plurality of scraper teeth along the lower edge thereof, said scraper teeth being spaced apart to define open spaces therebetween, and said rearward scraper blade including a lower scraper edge which is continuous along at least those transverse positions which follow in the path of said open spaces in said forward scraper blade.

2. The ice removing attachment of claim 1 wherein said lower scraper edge of said rearward scraper blade is continuous along the length of said rearward scraper blade.

3. The ice removing attachment of claim 1 wherein said means for rotatably supporting said roller on a vehicle is height adjustable.

4. The ice removing attachment of claim 3 wherein said means for supporting said first and second scraper blades on a vehicle is height adjustable independently of said means for rotatably supporting said roller.

5. The ice removing attachment of claim 1 wherein the cutting blades between each pair of cutting discs are positioned in circumferentially offset relation to the cutting blades between each adjacent pair of cutting discs.

6. The ice removing attachment of claim 5 wherein four cutting blades are provided between each pair of cutting discs, said four cutting blades being spaced apart at approximately 90° angles to one another.

7. The ice removing attachment of claim 1 wherein the peripheral cutting edge of each cutting disc comprises a plurality of replaceable arcuate cutting segments.

8. The ice removing attachment of claim 1 wherein said ice cutting roller includes a pair of first and second roller portions supported adjacent the forward end of said vehicle in transversely spaced relation, at least a portion of said first and second roller portions being positioned forwardly of the front wheels of the vehicle, said roller further comprising a third roller portion supported rearwardly of the vehicle front wheels and positioned to transversely span the spaced between the first and second roller portions.

9. The ice removing attachment of claim 8 wherein said forward and rearward scraper blades each include first and second blade portions supported in spaced apart relation adjacent the forward end of said vehicle behind said first and second roller portions and further comprising a third scraper blade supported rearwardly of said third roller portion for transversely spanning the space between said first and second blade portions respectively.

10. The ice removing attachment of claim 8 further comprising means for steerably supporting said first and second roller portions.

11. The ice removing attachment of claim 10 wherein said means for steerably supporting said first and second roller portions comprises an elongated tool bar extended transversely across the forward end of said vehicle and mounted for pivotal movement about a generally vertical axis, said first and second roller portions supported on opposite end portions of said tool bar and means for pivotally moving said tool bar about said vertical axis.

12. The ice removing attachment of claim 11 wherein said means for pivotally moving said tool bar comprises a pair of hydraulic cylinder units arranged on opposite sides of said vertical axis, each hydraulic cylinder unit connected at one end to the vehicle chassis and connected at the other end to said tool bar.

13. The ice removing attachment of claim 8 further comprising fourth and fifth roller portions supported in transversely spaced apart relation rearwardly of said third roller portion, said fourth and fifth roller portions being transversely arranged to at least partially overlap the paths traversed by said third roller portion and said first and second roller portions respectively and further comprising fourth and fifth scraper blades arranged rearwardly of said fourth and fifth roller portions for scraping away ice cut by said fourth and fifth roller portions.

14. The ice removing attachment of claim 13 further comprising a sixth scraper blade supported rearwardly of said fourth and fifth scraper blades, said sixth scraper blade being pivotally adjustable about a generally upright axis and being transversely coextensive with at least said fourth and fifth scraper blades.

15. The ice removing attachment of claim 1 further comprising means for rigidifying the suspension of said vehicle at times.

16. The ice removing attachment of claim 15 wherein said means for rigidifying the suspension of said vehicle comprises a toggle mechanism connected to and extended between the chassis and axle of the vehicle adjacent a spring thereof, said toggle mechanism, when expanded, forming a rigid link between said chassis and axle.

* * * * *